US007073226B1

(12) United States Patent
Lenkiewicz et al.

(10) Patent No.: US 7,073,226 B1
(45) Date of Patent: Jul. 11, 2006

(54) PORTABLE EXTRACTION CLEANER

(75) Inventors: Kenneth M. Lenkiewicz, Grand Rapids, MI (US); Alan J. Krebs, Pierson, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 421 days.

(21) Appl. No.: 10/065,891

(22) Filed: Nov. 27, 2002

Related U.S. Application Data

(60) Provisional application No. 60/340,066, filed on Nov. 30, 2001.

(51) Int. Cl.
*A47L 9/00* (2006.01)

(52) U.S. Cl. ..... 15/320; 15/321; 15/344; 15/323; 15/327.2; 15/353

(58) Field of Classification Search ..... 15/320, 15/321, 344, 353, 323, 327.2
See application file for complete search history.

(56) References Cited

U.S. PATENT DOCUMENTS

| | | | | | |
|---|---|---|---|---|---|
| 3,896,521 | A * | 7/1975 | Parise | 15/321 |
| 4,106,165 | A | 8/1978 | Clowers et al. | 15/323 |
| 4,114,231 | A * | 9/1978 | Nauta | 15/321 |
| 4,376,322 | A * | 3/1983 | Lockhart et al. | 15/323 |
| 4,724,573 | A * | 2/1988 | Ostergaard | 15/321 |
| 4,864,680 | A | 9/1989 | Blase et al. | 15/321 |
| 4,910,828 | A | 3/1990 | Blase et al. | 15/321 |
| 4,934,017 | A * | 6/1990 | Kent | 15/321 |
| 5,146,647 | A * | 9/1992 | Blase et al. | 15/321 |
| 5,237,719 | A * | 8/1993 | Dwyer et al. | 15/321 |
| 5,301,386 | A * | 4/1994 | Thomas et al. | 15/321 |
| 5,386,613 | A * | 2/1995 | Woo | 15/321 |
| 5,655,254 | A * | 8/1997 | Bores et al. | 15/320 |
| 5,657,509 | A * | 8/1997 | Trautloff et al. | 15/321 |
| 5,735,017 | A | 4/1998 | Barnes et al. | 15/321 |
| 5,799,362 | A | 9/1998 | Huffman | 15/321 |
| 5,870,798 | A | 2/1999 | Crouser et al. | 15/321 |
| 6,108,860 | A | 8/2000 | Crouser et al. | 15/321 |
| 6,243,913 | B1 * | 6/2001 | Frank et al. | 15/320 |
| 6,481,048 | B1 * | 11/2002 | Hauff et al. | 15/321 |

* cited by examiner

*Primary Examiner*—Theresa T. Snider
(74) *Attorney, Agent, or Firm*—McGarry Bair PC

(57) ABSTRACT

A portable extraction cleaning machine has a housing assembly including a housing enclosure centrally mounted on a housing base and a handle adapted for user carrying of the extraction cleaner, a suction motor and impeller assembly sealed within the housing enclosure and a solution tank for cleaning solution and a recovery tank removably mounted to the housing base in a fore and aft position. The recovery tank has an integrally molded spout and an air/liquid separator comprising a riser tube having an internal divider separating the riser tube into fluidly isolated first and second conduits. A plurality of different decorative face plates are adapted to be removably mounted to the housing enclosure and each of which is adapted to cover at least a substantial visible portion of the visible surface of the housing enclosure when mounted on the housing enclosure.

41 Claims, 7 Drawing Sheets

PORTABLE EXTRACTION CLEANER

CROSS REFERENCE TO RELATED APPLICATIONS

This application claims the benefit of U.S. Provisional Application Ser. No. 60/340,066, filed Nov. 30, 2001, entitled "Portable Extraction Cleaner."

BACKGROUND OF INVENTION

1. Field of the Invention

The invention relates to extraction cleaners. In one of its aspects, the invention relates to a portable extraction cleaner that is adapted to be hand carried by a user to carpeted areas of cleaning relatively small areas, such as small rugs and upholstery. In another of its aspects, the invention relates to a portable extraction cleaner that is easy to use. In another of its aspects, the invention relates to a portable extraction cleaner having a clean air extraction system with improved noise reduction. In another of its aspects, the invention relates to a portable extraction cleaner with drop-in clean solution and recovery tanks for ease of operation and servicing. In yet another of its aspects, the invention relates to a portable extraction cleaner with an improved electric cord management. In yet another of its aspects, the invention relates to a well-balanced portable extraction cleaner that is easy to hand carry from place to place by a user.

2. Description of the Related Art

Portable extraction cleaners are disclosed in U.S. Pat. No. 4,910,828 to Blase et al., issued Mar. 27, 1990, in U.S. Pat. No. 6,108,860 to Crouser et al., issued Aug. 29, 2000, in U.S. Pat. No. 5,799,362 to Huffman, issued Sep. 1, 1998, and U.S. Pat. No. 5,735,017 to Barnes et al., issued Apr. 7, 1998. Each of these extractions cleaners has a canister housing that is adapted to be carried by a user for cleaning relatively small areas of a floor or upholstery surface. The size of these cleaners is particularly suitable for cleaning stairs, for example, as well as small soiled areas of carpet. Each of these cleaners has a cleaning solution delivery system to apply cleaning solution to a surface to be cleaned and a fluid recovery system for recovering soiled cleaning solution from the surface to be cleaned both of which include a hose that is attached to the canister housing at one end and to a cleaning tool at another end.

These cleaners are also powered by electricity supplied by an electric cord. The storage of the hose and the electrical cord when the cleaner is not in use has always presented a problem.

The canister housings have also been molded of a colored plastic material that can be colorful. However, any color may appeal to one customer and not to another. Due to the limitation of shelf space and inventory control, it has not been thought to make these cleaners in many different colors.

Further, the small footprint and portability of these machines have presented challenges in packaging the separate solution and recovery tanks in a way for easy removal and replacement of the tanks in the canister housing. In addition, maintaining a proper weight balance for carrying these small cleaners has also been a challenge, especially in view of the varying amounts of liquid that may be present in the solution and recovery tanks during use of the cleaners.

In addition, the small package coupled with high efficiency motors and impellers result in undesirable noise in the home environment.

SUMMARY OF INVENTION

According to the invention, a portable extraction cleaner includes a main housing assembly comprising a housing enclosure mounted, preferably centrally, on a housing base, and a suction motor and impeller assembly mounted within the housing enclosure. A solution tank for cleaning solution is removably mounted to the housing base at one side of the housing enclosure and a recovery tank is mounted to another side, preferably opposite the one side, thereof.

Preferably, each of the clean solution tank, the recovery tank and the housing base are configured to drop generally vertically into the housing base, requiring no pivoting or rotation for installation and thereby contributing to the ease of attachment of these assemblies. A flexible suction hose is mounted to the housing base and is connected to the recovery tank for recovery of cleaning fluid deposited on a surface to be cleaned. A cleaning tool with a suction nozzle is mounted to a free end of the suction hose for recovering soiled cleaning fluid from a surface on which cleaning fluid has been deposited. The impeller assembly has an inlet opening in communication with the suction hose for drawing soiled cleaning fluid recovered from the surface to be cleaned through the hose and depositing the same in the recovery tank.

Preferably, the recovery tank is mounted fluidly between the hose and the impeller assembly and a working air conduit is provided to the impeller inlet opening from the recovery tank through the housing base. A seal is provided between an end of the working air conduit and the recovery tank.

In one embodiment, clean air exhaust vents are provided on a side of the housing base and are connected to an impeller outlet opening for exhausting air from the housing enclosure. The suction motor and impeller assembly are part of a sealed clean air extraction system that reduces noise to the surrounding area due to the isolation of the suction motor and impeller assembly and the positioning of exhaust vents on the underside of the extraction cleaner.

An integrally molded handle is formed on an upper portion of the housing enclosure. The extraction cleaner is well balanced for carrying with the suction motor positioned below the integrally molded handle with the solution and recovery tanks flanking these components. Minimizing "spitting" of recovered fluid outside of the recovery tank is achieved due to the positive seal between the working air conduit and the recovery tank and due to a negative pressure developed in the recovery tank.

Preferably, the clean solution and recovery tanks are transparent or translucent for viewing fluid levels within the tanks. The tanks further include integrally molded indented handgrips for grasping by the user.

In a preferred embodiment cord wraps are mounted to the housing enclosure for storing a power cord in a neat and accessible fashion. Further, the base housing includes indentations for storing the flexible hose when it is not in use.

In another embodiment, the housing enclosure is provided with one or more removable faceplates that can be changed at the user's discretion for selection of a desirable color or indicia.

In a preferred embodiment, the recovery tank has a pour spout at an upper portion adjacent to the housing enclosure. A pour spout cover is pivotally mounted on the housing enclosure for movement from an overlying position to an open position. The pour spout cover has an over-center latch for positively sealing the pour spout in the overlying position and for retaining the pour spout cover free of the pour spout in the open position.

DETAILED DESCRIPTION

Figure 1:
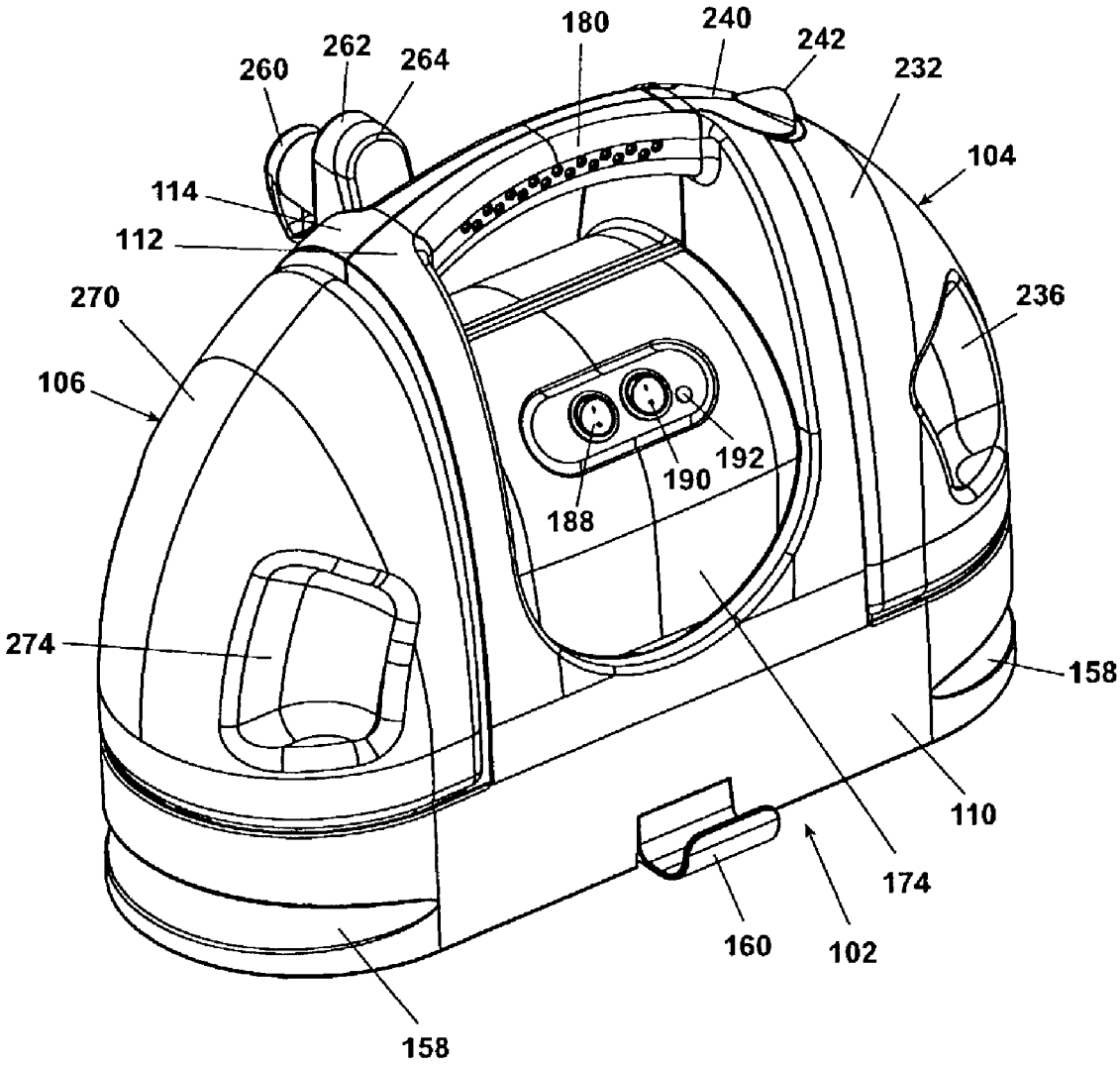
FIG. 1 is a perspective view of a portable extraction cleaner according to the invention.
Figure 2:
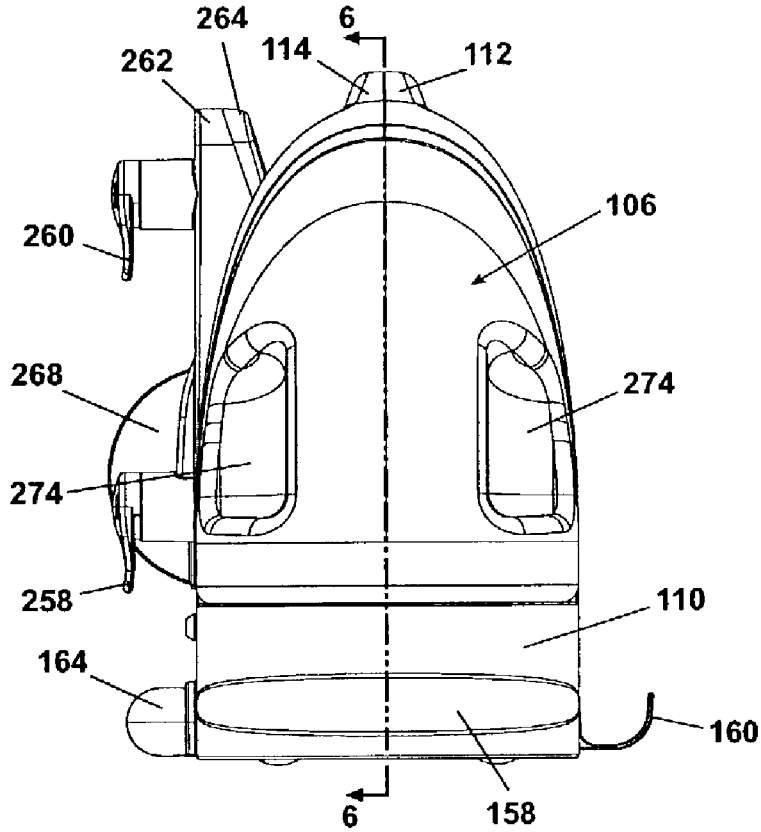
FIG. 2 is a left side view of the portable extraction cleaner of FIG. 1.
Figure 3:
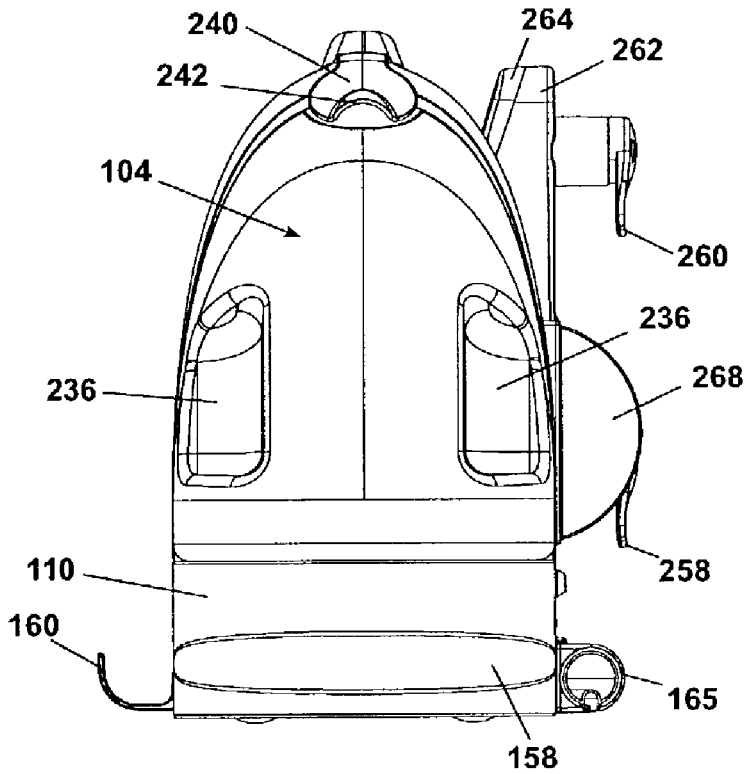
FIG. 3 is a right side view of the portable extraction cleaner of FIGS. 1–2.

Referring to FIGS. 1–5, a portable extraction cleaner according to the invention comprises a main housing assembly 102, a recovery tank assembly 104 and a clean solution tank assembly 106. The main housing assembly 102 comprises a housing base 110 and first and second shell halves 112, 114. The recovery tank assembly 104 is principally contained within a recovery tank 232 having integrally molded handgrip indentations 236. In a preferred embodiment, main housing assembly 102 is formed of an opaque material, but can be formed of a translucent or transparent material. The recovery tank 232 can be formed of a transparent or tinted translucent material for user viewing of the contents of the tanks.

The housing base 110 is defined about its perimeter by a skirt 150 having a hose clip receiving recess 162 on the front face thereof and a flexible suction hose recess 1158 on each end thereof. The hose clip receiving recess 162 is adapted to receive a flexible suction hose clip 160. A housing to base retainer clip 300 acts to hold first and second shell halves 112, 114 to housing base 110.

First shell half 112 includes an integrally molded handle portion 180 and an integrally molded clean solution tank guide rail portion 168 having a rail wing 170. The first shell half 112 further includes a first power switch aperture 182 and a second power switch aperture 184 for receiving first and second power switches 188, 190 respectively. In a preferred embodiment, power switches 188, 190 selectively direct power to the suction/solution pumps and the block heater respectively. Embodiments without a heater can have only one power switch, or the suction and solution pumps could be independently switchable. An indicator light aperture 186 for receiving a power indicator light 192 is located adjacent the power switch apertures 182, 184. A faceplate 174 is adapted to mount onto first shell half 112 and includes a faceplate power switch aperture 176 for placement over the power switch apertures 182, 184 of the first shell half 112. The faceplate 174 includes a retainer tab 178 adapted to be received in a faceplate retainer slot 172 on the first shell half 112. The upper edge of faceplate 174 is held by a faceplate retaining lip 266 in second shell half 114. The faceplate 174 can be tinted or otherwise colored to accent or provide contrast to the appearance of the extraction cleaner. For example, an opaque white housing assembly 102 can be accented by a faceplate 174 having a color selectable by a user.

Figure 4:
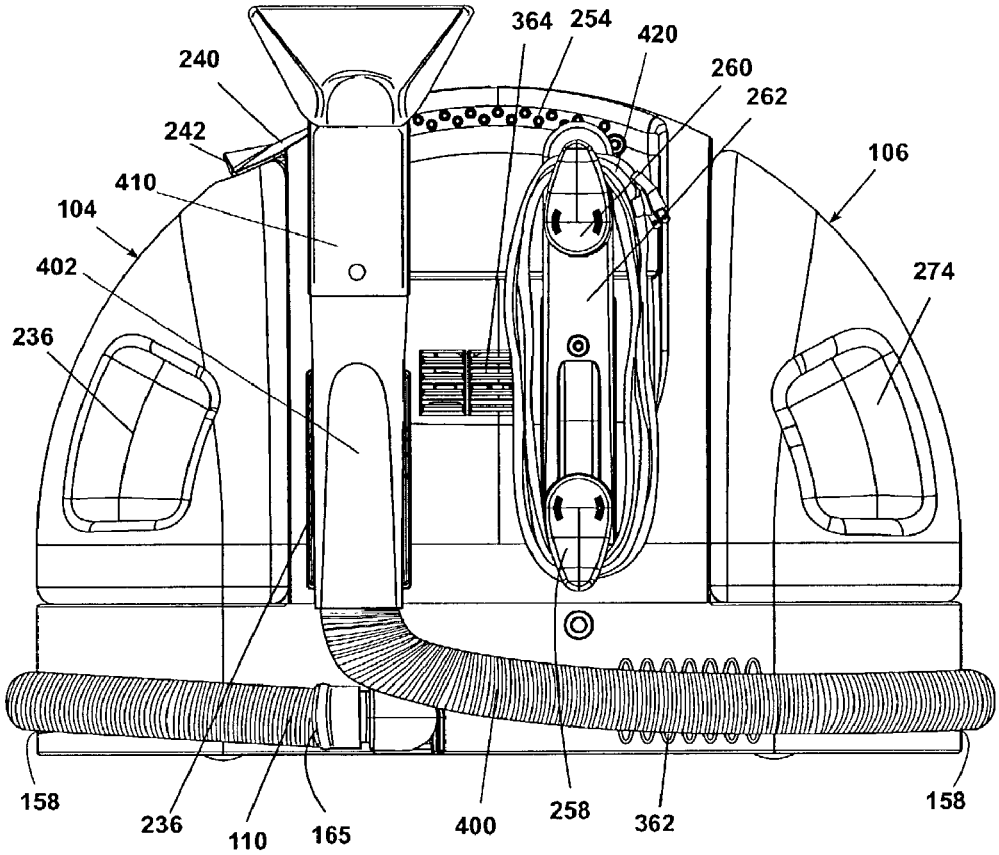
FIG. 4 is a rear side view of the portable extraction cleaner of FIGS. 1–3.

The second shell half 114 includes an integrally molded handle portion 254 and an integrally molded clean solution tank guide rail portion 256. A cord wrap base 262 having a cord wrap cap 264 and mounting a lower cord wrap 258 and an upper cord wrap 260 is mounted to the outer surface of the second shell half 114. A power cord 420 is shown in FIG. 4 carried by cord wraps 258, 260. A hose wand grip retaining bracket 268 is also mounted to the outer surface of the second shell half 114. A hose wand grip 402 mounting a cleaning tool 410 attached to a flexible suction hose 400 is shown in the retaining bracket 268 in FIG. 4. The power cord 420, cleaning tool 410 and suction hose 400 are not shown in other figures for the purpose of clarity of those figures.

The recovery tank assembly 104 includes a recessed lower portion 234 and is aligned on the main housing assembly 102 with the recessed lower portion 234 nesting within skirt 150 as the recovery tank 232 is vertically aligned and lowered onto the housing base 110. Recovery tank assembly 104 is retained on main housing assembly 102 by a recovery tank cap 240 pivotally mounted to the main housing assembly 102 and having a grasping portion 242. Recovery tank 232 is thus inserted into housing base 110 vertically without any pivoting or rotation of tank 232 required.

Recovery tank cap 240 includes a resilient seal 244 for forming a watertight seal at the spout 238 of recovery tank 232 when the recovery tank cap 240 is in the closed position, retaining the recovery tank 232 on the housing base 110. The recovery tank cap 240 is securely retained in a closed position by an integrally formed projection 248 forming an over-center mechanism. The connection between the projection 248 and the remainder of tank cap 240 is resilient. Recovery tank cap 240 rotates about hinge pins 246 relative to shell halves 112, 114. As recovery tank cap 240 is rotated into the closed position shown in FIG. 6, there is insufficient clearance between projection 248 and a boss 252 integrally molded into second shell half 114. The connection between projection 248 and the rest of cap 240 thus flexes until the boss 252 slips into a concave face 250 of projection 248. The recovery tank cap 240 is thus locked into position with the boss 252 in concave face 250, the recovery tank cap 240 securely holding recovery tank 232 in place on housing base 110 and fluidly sealing spout 238. A user grasping the grasping portion 242 opens the recovery tank cap 240 by pulling upwardly to overcome the resistance between resiliently mounted projection 248 and boss 252 in concave face 250, as projection 248 flexes toward cap 240. Recovery tank cap 240 is thus sufficiently resistant to opening to prevent inadvertent spilling of fluid in recovery tank 232. With recovery tank cap 240 in the open position, projection 248 bears against boss 252 to prevent recovery tank cap 240 from falling closed. Recovery tank cap 240 will remain in the open position until the user exerts sufficient downward force to cause projection 248 to flex toward cap 240 far enough to allow boss 252 to slip again into concave face 250.

Figure 5:
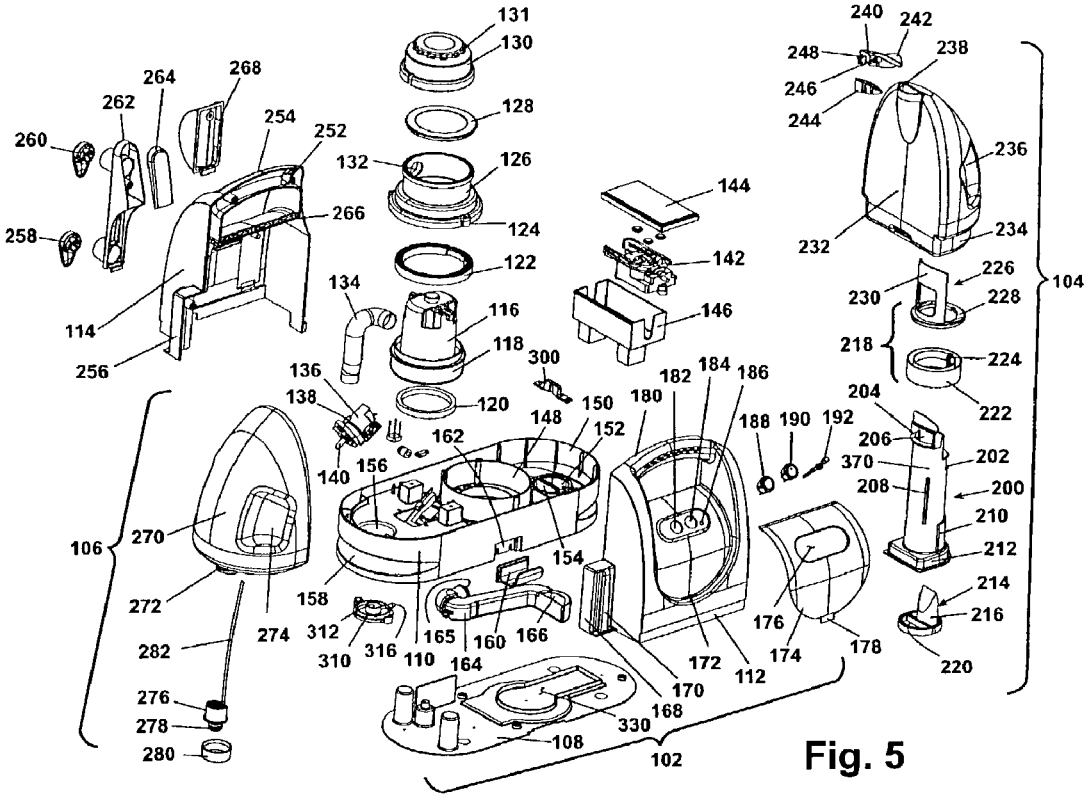
FIG. 5 is an exploded perspective view of the portable extraction cleaner of FIGS. 1–4.
Figure 7:
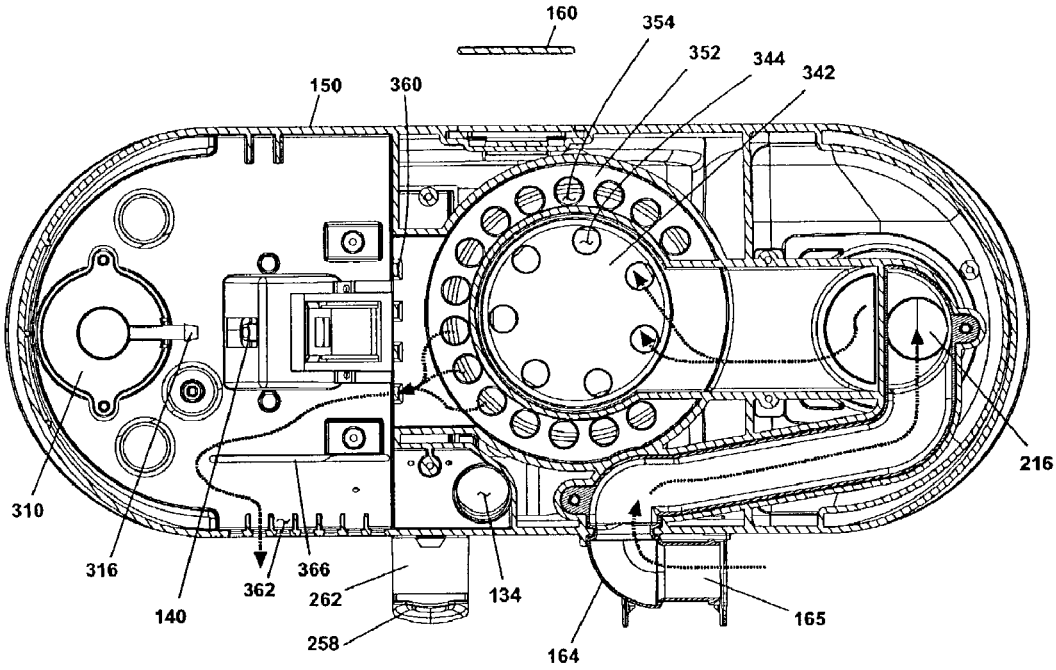
FIG. 7 is a cross-sectional view taken through line 7—7 of FIG. 6.
Figure 8:
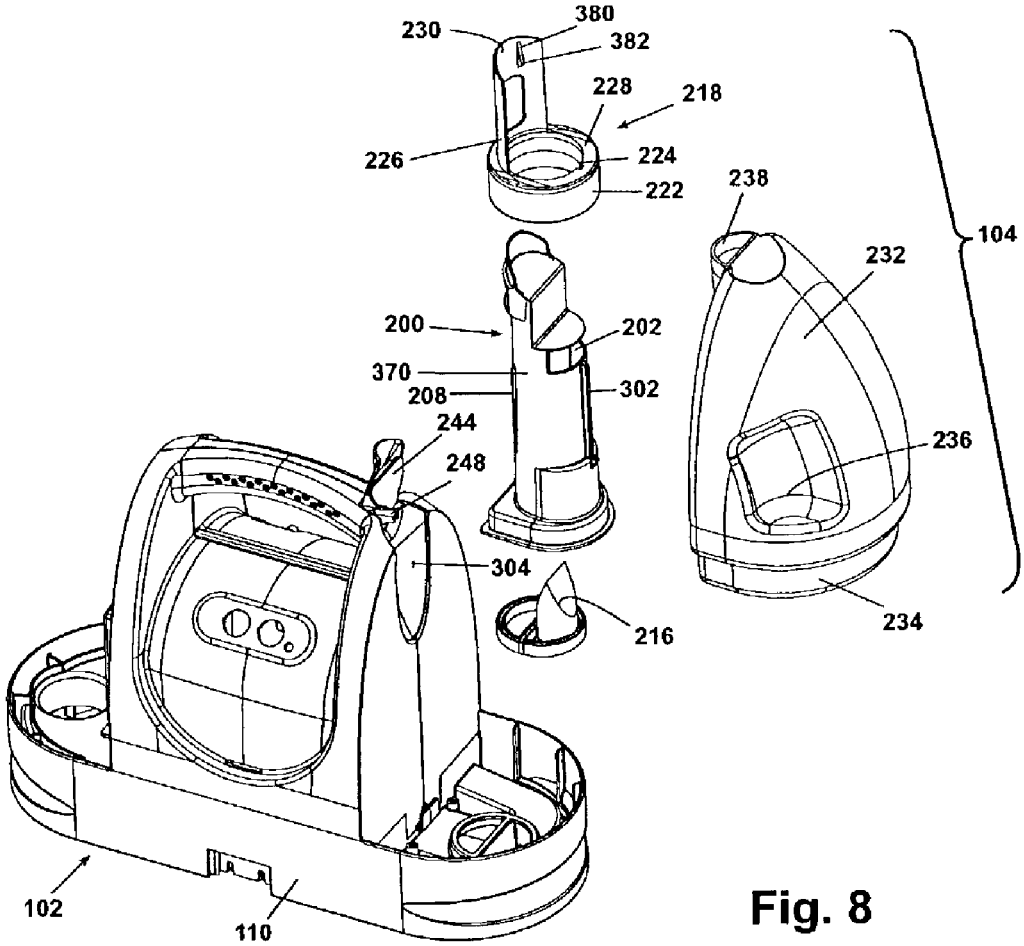
FIG. 8 is an exploded perspective view of the recovery tank and main housing of the portable extraction cleaner of FIGS. 1–7.

Referring now to FIGS. 5 and 7–8, the recovery tank assembly 104 comprises a blow-molded recovery tank 232 and an air/liquid separator assembly 200. The air/liquid separator assembly 200 comprises a riser tube 370 having a central internal divider 206 dividing the tube into two fluidly isolated conduits 372, 374.

First conduit 372 includes a recovered fluid port 202 open to the interior of the recovery tank 232 and is fluidly connected to suction hose 400 of the portable extraction cleaner through a recovery tank fluid port 152 when mounted on the portable extraction cleaner. The second conduit 374 includes a suction port 204 and is fluidly connected to an impeller compartment 148 through a suction plenum 330 when the recovery tank assembly 104 is mounted on the portable extraction cleaner.

An air/liquid separator seal 214 provides a fluid-tight seal between the air/liquid separator assembly 200 and the portable extraction cleaner. The air/liquid separator seal 214 incorporates a backflow preventer in the form of a duckbill valve 216 to prevent escape of fluid drawn into the air/liquid separator assembly 200. As a suction force is generated within the recovery tank 232, the apex of the duckbill valve 216 separates to allow fluid to pass through the valve 216. When this force is removed, the valve 216 is naturally biased to close and prevent backflow of liquid.

The air/liquid separator assembly 200 further comprises a float assembly 218. The float assembly 218 includes a hollow annular float body 222 and a float cap/air suction port cover 226. The float cap/air suction port cover 226 comprises a float cap portion 228 for sealing the hollow annular float body 222 and an air suction port cover portion 230. The annular float body 222 has an internal guide slot 224 for aligning the float body on the riser 370. The riser 370 includes a guide rib 302 for aligning the float body 222. The riser 370 further includes a pair of spacing alignment ribs 208 to keep the riser 370 centered within the annular float body 222 in a non-frictional relationship to allow the annular float body 222 to slide freely along the riser 370.

The air suction port cover 230 is adapted to fluidly seal the air suction port 204. With the recovery tank 232 in the upright position and void of fluid, the float assembly 218 will normally rest on a shoulder 210 formed in the outer portion of the riser 370. In this condition, the air suction port cover 230 is clear of the air suction port 204 so that a suction airflow can pass freely through the air suction port 204.

As the recovery tank 232 fills with fluid, the float assembly 218 rises with the rising fluid until the air suction port cover 230 covers the air suction port 204. The face of the air suction port cover 230 includes a ramped spacer 380 that separates the rising air suction port cover 230 from the air suction port 204 until a lower edge 382 of the spacer 380 clears the lower edge of the air suction port 204. When the lower edge 382 of the spacer 380 clears the lower edge of the air suction port 204, the air suction port cover 230 is drawn onto the air suction port 204 by the suction air flow to prevent liquid from being drawn into the air suction port 204.

The air/liquid separator assembly 200 further includes a base 212 adapted to fit in a sealing fashion to the underside of recovery tank 232. The base 212 is further adapted to receive the air/liquid separator seal 214 so that the duckbill valve 216 is received in the first conduit 372 while a suction airflow aperture 220 is aligned with the second conduit 374.

Figure 6:
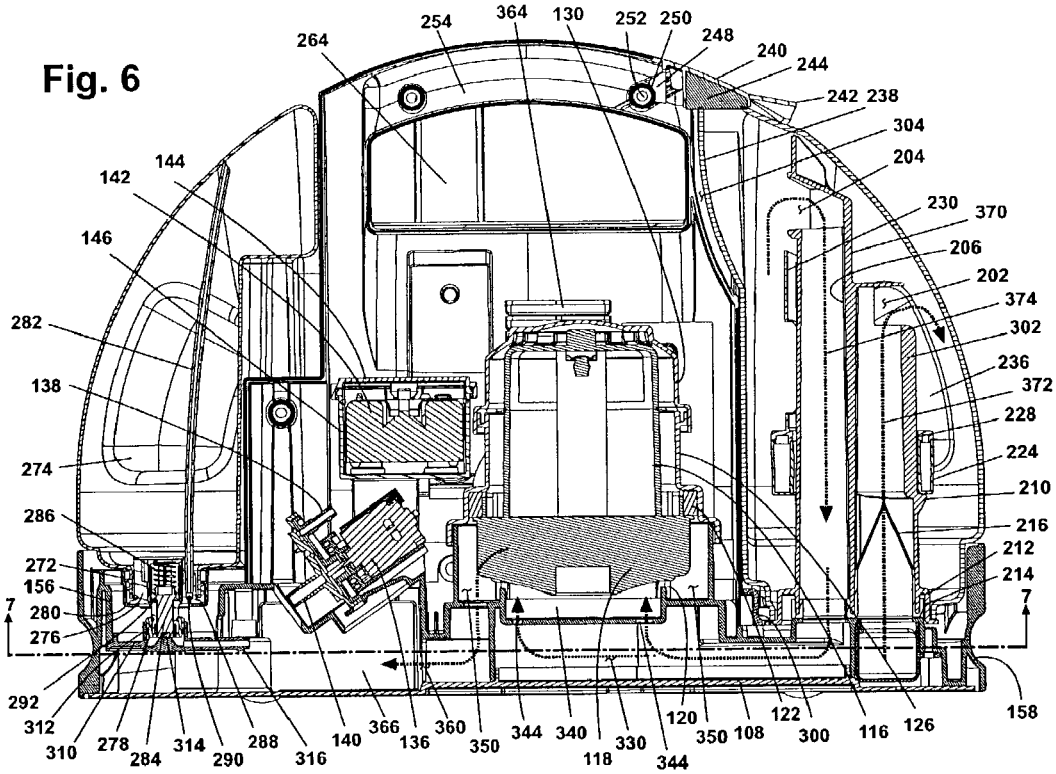
FIG. 6 is a cross-sectional view taken through line 6—6 of FIG. 2.

With particular reference to FIGS. 5–7, the air/liquid separator assembly 200 compresses the air/liquid separator seal 214 against the recovery tank fluid port 152 and a recovery tank suction port 154 integrally formed in the housing base 10. The recovery tank fluid port 152 is sealingly connected to the first conduit 372 and the recovery tank suction port 154 is sealingly connected to the second conduit 374.

A fluid recovery conduit 164 includes a flexible hose fitting 165 and a fluid recovery conduit outlet 166. The fluid recovery conduit 164 is formed to be mounted to an underside of the housing base 110 so that it passes through the base skirt 150 with the flexible hose fitting 165 positioned outside the skirt 150 and aligned parallel thereto. Flexible hose 400 is fluidly connected to fitting 165 (see FIG. 4). The fluid recovery conduit 164 is further configured to mount to the underside of housing base 110 so that fluid recovery conduit outlet 166 is sealingly received within recovery tank fluid port 152 to be fluidly connected to first conduit 372 of the air/liquid separator assembly 200 through the duckbill valve 216.

The clean solution tank assembly 106 comprises a clean solution tank 270 having integrally molded handgrip indentations 274. The clean solution tank assembly 106 is aligned and retained on the main housing assembly 102 by vertically sliding an integrally formed recess in the clean solution tank 270 over the clean solution tank guide rails 168, 256 integrally formed in the housing shell halves 112, 114. Clean solution tank assembly 106 is thus mounted on main housing assembly 102 and housing base 110 in a linear fashion with no rotation or pivoting of assembly 106 required. The clean solution tank 270 can be formed of a transparent or a translucent material for customer viewing.

The clean solution tank assembly 106 further comprises a threaded neck 272. A valve assembly 276 is inserted into the threaded neck 272. The valve assembly 276 comprises a spring-loaded plunger 284 biased by a spring 286 to form a seal using an O-ring 292. Valve assembly 276 is retained in threaded neck 272 by retainer ring 280. A clean solution tank valve assembly aperture 156 is formed in housing base 110 and adapted to mount a valve receiver 310 for fluidly connecting to the valve assembly 276. As the clean solution tank assembly 106 is lowered vertically onto the housing base 110, the valve assembly 276 aligns with and is inserted into the valve assembly aperture 156.

The valve assembly 276 further comprises a vacuum relief tube 282 fluidly connected to atmosphere through an opening 290. A ball bearing 288 seals the opening 290 under the force of gravity to prevent fluid from passing from the tube 282. As liquid is drawn from the clean solution tank 270, atmospheric pressure forces the ball bearing 288 upward to allow air to enter tank 270 to relieve the vacuum developed as the cleaning solution is dispensed.

When the clean solution tank assembly 106 is mounted on the portable extraction cleaner, a pin 314 in the well 312 of the valve receiver 310 depresses the plunger 284 against the biasing force of spring 286. The interior of clean solution tank 270 thus becomes fluidly connected through the receiver 310 and the valve receiver outlet 316 to the inlet port 140 of a clean solution pump 136 via flexible tubing (not shown). A clean solution pump outlet port 138 is likewise fluidly connected to a clean solution spray nozzle on cleaning tool 410.

In a preferred embodiment, a block heater 142 is housed within the housing assembly 102 within a block heater enclosure 146 having a block heater enclosure cap 144. In the preferred embodiment, the block heater 142 is positioned proximate the clean solution pump 136. The clean solution pump outlet port 138 is fluidly connected to the block heater 142, which is further fluidly connected to the clean solution spray nozzle of cleaning tool 410. The construction and modes of operation of a suitable block heater 142 are disclosed more fully in U.S. Pat. No. 6,131,237, entitled Upright Extraction Cleaner and issued Oct. 17, 2000, which is incorporated herein by reference in its entirety. In an alternative embodiment without a block heater, a cleaning solution in the clean solution tank can be heated by any known exothermic reaction as disclosed in commonly owned U.S. patent application Ser. No. 10/065,480, entitled EXTRACTOR WITH CHEMICAL EXOTHERMIC REACTION HEATING and filed Oct. 2, 2002, which is incorporated herein by reference.

A suction motor 116 with an attached impeller assembly 118 is positioned in a central portion of the base 110 comprising the suction impeller enclosure 148. The central placement of the suction motor 116 and impeller assembly 118 within the cleaner provides an optimal carrying balance for the user by placing the weight of the elements directly below the integrally mounted handle. A ring-type seal 120 seals a lower surface of the impeller 118 within the impeller enclosure 148. An impeller enclosure seal 122 seals a top portion of the impeller assembly 118 on the impeller enclosure 148 so as to isolate the impeller enclosure 148 from the suction motor 116. The suction motor 116 and impeller assembly 118 are held in place by the suction motor enclosure 126 secured to the impeller enclosure 148. Fasteners (not shown) are passed through ears 124 to secure the suction motor enclosure 126 to the impeller enclosure 148. A gasket 128 and suction motor enclosure 130 enclose the motor 116.

The suction motor enclosure cap 130 includes a plurality of apertures 131 for allowing cooling air into the motor enclosure 126. The motor enclosure 126 includes motor-cooling air exhaust conduit aperture 132 for fluidly connecting the interior of the motor enclosure 126 to the atmosphere via motor-cooling air conduit 134. Cooling air thus passes from the apertures 131 into the motor enclosure 126 and is exhausted through motor-cooling air exhaust conduit 134. Second shell half 114 includes a number of inlet air apertures 364 for the flow of motor-cooling air to the interior of the housing assembly 102.

Referring now to FIGS. 6–7, when power is applied to the motor 116, it drives impeller 118 to generate a suction force in impeller inlet chamber 340. The impeller inlet chamber 340 is fluidly connected to the interior of recovery tank 232 through suction plenum 330 and second conduit 374. The interior of recovery tank 232 is further fluidly connected to the flexible suction hose 400 and cleaning tool 410 through first conduit 372, duckbill valve 216 and fluid recovery conduit 164.

As shown by arrows in FIGS. 6–7, the suction force at a suction nozzle of the cleaning tool draws fluid (air/liquid) through the cleaning tool and flexible hose into the fluid recovery conduit 164 and to the duckbill valve 216. Under the force of suction, this fluid passes through the duckbill valve 216, first conduit 372 and recovered fluid port 202 into the interior of recovery tank 232. Liquid and debris in the fluid fall under the force of gravity to the bottom of the recovery tank 232.

The air drawn into the recovery tank 232, now devoid of liquid and debris, is drawn to air suction port 204 and into second conduit 374. The air then passes from second conduit 374 to suction plenum 330, integrally formed in bottom plate 108, and apertures 344 in the bottom wall 342 of the impeller inlet chamber 340. The air passes through the impeller 118 to an impeller outlet chamber 350. Impeller outlet chamber 350 is separated from inlet chamber 340 by impeller 118 and seal 120. This exhaust air then passes through apertures 354 in a bottom wall 352 of the impeller outlet chamber 350 and through exhaust air outlet apertures 360 to a void between housing base 110 and bottom plate 108. This exhaust air is then vented to atmosphere through skirt vent openings 362. An exhaust air outlet baffle 366 is positioned between the exhaust air outlet apertures 360 and the skirt vent openings 362. This circuitous routing of the exhaust air from the impeller assembly serves to quiet the operation of the extraction cleaner as it greatly reduces the portion of noise generated by the impeller assembly that escapes the extraction cleaner into the surrounding area.

As recovery tank 232 fills with liquid and debris, float assembly 218 rises with the level of the liquid in the tank 232 until the air suction port cover 230 covers air suction port 204. The user must then discard the collected liquid and debris by grasping the grasping portion 242 of the recovery tank cap 240 and pulling to overcome the resistance from projection 248 on boss 252. The recovery tank 232 can then be removed from housing base 110 by grasping at handgrip indentations 236. Liquid and debris are poured out of recovery tank 232 through spout 238. Duckbill valve 216 prevents liquid from inadvertently spilling out of first conduit 372 should the recovery tank 232 be inclined away from spout 238.

The portable extraction cleaner is thus disclosed as including a main housing assembly 102 centrally mounted on a housing base 110 and enclosing a suction motor 116 and impeller assembly 118. The extraction cleaner is well balanced for carrying with the suction motor 116 positioned below the integrally molded handle of the extraction cleaner. The suction motor 116 and impeller assembly 118 are part of a sealed clean air extraction system that reduces noise to the surrounding area due to the isolation of the suction motor and impeller assembly 118, and the positioning of the exhaust vents on the underside of the extraction cleaner. Each of the clean solution tank assembly 106 and the recovery tank assembly 104 are arranged to drop in vertically onto housing base 110, requiring no pivoting or rotation for installation, contributing to the ease of attachment of these assemblies and minimizing "spitting" of recovered fluid outside of the extraction cleaner due to the positive seal between the extraction cleaner and the recovery tank assembly 104 and due the negative operating pressure developed in the recovery tank assembly 104. The clean solution and recovery tanks 270, 232 are transparent or translucent for viewing fluid levels within the tanks. The tanks include integrally molded handgrips for grasping by the user. The power cord 420 is stored in a neat and accessible fashion on cord wraps 258, 260 mounted to main housing assembly 102. The flexible suction hose 400 and cleaning tool 410 are also provided with a handy storage capability on the extraction cleaner. The extraction cleaner is provided with a faceplate that can be changed at the user's discretion for selection of other colors or indicia.

While the invention has been specifically described in connection with certain specific embodiments thereof, it is to be understood that this is by way of illustration and not of limitation. Reasonable variation and modification are possible within the scope of the forgoing description and drawings without departing from the scope of the invention which is described in the appended claims.

The invention claimed is:

1. A portable extraction cleaner comprising:

a housing assembly including a housing enclosure centrally mounted on a housing base and handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator;

wherein the solution tank and the recovery tank are mounted to forward and rearward ends of the housing assembly and the handle is oriented in a forward to rear direction.

2. The portable extraction cleaner in accordance with claim 1 wherein the solution tank and the recovery tank are configured for vertical movement into and out of the housing base.

3. The portable extraction cleaner according to claim 2 and further comprising a flexible suction hose mounted to the housing assembly and connected to the recovery tank for recovery of cleaning fluid deposited on a surface to be cleaned and a cleaning tool with a suction nozzle mounted to a free end of the suction hose for recovering soiled cleaning fluid from a surface on which cleaning fluid has been deposited.

4. The portable extraction cleaner according to claim 3 wherein the impeller assembly has an inlet opening in communication with the suction hose for drawing soiled cleaning fluid recovered from the surface to be cleaned through the hose and depositing the same in the recovery tank.

5. The portable extraction cleaner according to claim 4 wherein the recovery tank is fluidly connected between the hose and the impeller assembly.

6. The portable extraction cleaner according to claim 4 and further comprising a working air conduit through the housing base between the impeller inlet opening and the recovery tank.

7. The portable extraction cleaner according to claim 6 and further comprising a seal between an end of the working air conduit and the recovery tank.

8. The portable extraction cleaner according to claim 7 and further comprising clean air exhaust vents on a side of the housing base connected to an impeller outlet opening for exhausting air from the housing enclosure.

9. The portable extraction cleaner according to claim 8 wherein the suction motor and impeller assembly are sealed in the housing enclosure with the exception of the impeller inlet opening and exhaust outlet opening.

10. The portable extraction cleaner according to claim 1 wherein the handle is integrally molded with the housing enclosure and at an upper portion thereof.

11. The portable extraction cleaner according to claim 1 wherein the suction motor and impeller assembly are sealed in the housing enclosure with the exception of the impeller inlet and exhaust outlet.

12. The portable extraction cleaner according to claim 11 and further comprising exhaust vents connected to an impeller outlet in the housing base at a side thereof.

13. The portable extraction cleaner according to claim 1 and further comprising pair of cord wrap retainers mounted onto the housing enclosure.

14. The portable extraction cleaner according to claim 13 wherein the cord wrap retainers are mounted in vertical juxtaposition to each other.

15. The portable extraction cleaner according to claim 1 wherein the at least one of the solution tank and the recovery tank have indented hand grips on side walls thereof for user grasping of the tanks for removal from and replacement on the housing base.

16. The portable extraction cleaner according to claim 15 wherein both of the solution and recovery tanks have indented hand grips on sidewalls thereof.

17. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator;

a flexible suction hose mounted to the housing assembly and connected to the recovery tank for recovery of cleaning fluid deposited on a surface to be cleaned and a cleaning tool with a suction nozzle mounted to a free end of the suction hose for recovering soiled cleaning fluid from a surface on which cleaning fluid has been deposited; and indentations in an outer surface of the housing base for receiving and positioning the flexible suction hose when the hose is wrapped around the housing base for storage when the extraction cleaner is not in use or is being carried.

18. The portable extraction cleaner according to claim 17 and further comprising a clip on the housing assembly for releasably retaining the free end of the flexible hose when the hose is wrapped around the housing base.

19. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator; and a decorative face plate that is removably mounted to the housing enclosure and that is adapted to cover at least a substantial visible portion of the visible surface of the housing enclosure.

20. The portable extraction cleaner according to claim 19 wherein at least one of the clean solution and recovery tanks are made of transparent or translucent material for viewing fluid levels within the tanks.

21. The portable extraction cleaner according to claim 19 and further comprising a plurality of different decorative face plates that are adapted to be removably mounted to the housing enclosure and each of which is adapted to cover at least a substantial visible portion of the visible surface of the housing enclosure when mounted on the housing enclosure.

22. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator; and a plurality of different decorative face plates that are adapted to be removably mounted to the housing enclosure and each of which is adapted to cover at least a substantial visible portion of the visible surface of the housing enclosure when mounted on the housing enclosure.

23. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator, the recovery tank further has a pour spout at an upper portion adjacent to the housing enclosure; and a pour spout cover pivotally mounted on the housing enclosure for movement from an overlying position to an open position with respect to the pour spout.

24. The portable extraction cleaner according to claim 23 wherein the pour spout cover has an over-center latch for positively sealing the pour spout in the overlying position and for retaining the pour spout cover free of the pour spout in the open position.

25. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator;

wherein the air/liquid separator is formed from a riser tube having an internal divider separating the riser tube into fluidly isolated first and second conduits, and each of the first and second conduits are fluidly connected to the interior of the recovery tank through an aperture at an upper end thereof.

26. The portable extraction cleaner according to claim 25 and further comprising a float assembly slidably mounted on the riser tube and having an aperture cover adapted to cover the aperture of the second conduit as fluid rises to a predetermined level within the recovery tank and a backflow prevention valve positioned in the first conduit to prevent fluid from passing from the interior of the recovery tank out through the first conduit.

27. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator;

a flexible suction hose mounted to the housing assembly and connected to the recovery tank for recovery of cleaning fluid deposited on a surface to be cleaned and a cleaning tool with a suction nozzle is mounted to a free end of the suction hose for recovering soiled cleaning fluid from a surface on which cleaning fluid has been deposited; wherein the impeller assembly has an inlet opening in communication with the suction hose for drawing soiled cleaning fluid recovered from the surface to be cleaned through the hose and depositing the same in the recovery tank; and a working air conduit through the housing base between the impeller inlet opening and the recovery tank.

28. The portable extraction cleaner according to claim 27 wherein the recovery tank is fluidly connected between the hose and the impeller assembly.

29. The portable extraction cleaner according to claim 27 and further comprising a seal between an end of the working air conduit and the recovery tank.

30. The portable extraction cleaner according to claim 29 and further comprising clean air exhaust vents on a side of the housing base connected to an impeller outlet opening for exhausting air from the housing enclosure.

31. The portable extraction cleaner according to claim 30 wherein the suction motor and impeller assembly are sealed in the housing enclosure with the exception of the impeller inlet and exhaust outlet.

32. A portable extraction cleaner comprising:

a housing assembly including a housing enclosure mounted on a housing base and a handle adapted for user carrying of the extraction cleaner;

a suction source mounted within the housing enclosure;

a solution tank for cleaning solution and a recovery tank removably mounted to the housing base adjacent to the housing enclosure; and wherein the recovery tank has a pour spout at an upper portion adjacent to the housing enclosure; and a pour spout cover pivotally mounted on the housing enclosure for movement from an overlying position to an open position.

33. The portable extraction cleaner according to claim 32 wherein the pour spout cover has an over-center latch for positively sealing the pour spout in the overlying position and for retaining the pour spout cover free of the pour spout in the open position.

34. The portable extraction cleaner according to claim 32 and further comprising indented hand grips formed in side walls of the recovery tank distal from the housing enclosure for gripping by a hand of a user for removal of the recovery tank from the base and for pouring liquid from the base through the pour spout.

35. A portable extraction cleaner comprising:

a housing assembly including a housing enclosure mounted on a housing base and a handle adapted for user carrying of the extraction cleaner;

a suction source mounted within the housing enclosure;

a solution tank for cleaning solution and a recovery tank removably mounted to the housing base; and wherein the recovery tank has an the air/liquid separator formed from a riser tube having an internal divider separating the riser tube into fluidly isolated first and second conduits, and each of the first and second conduits are fluidly connected to the interior of the recovery tank through an aperture at an upper end thereof.

36. The portable extraction cleaner according to claim 35 and further comprising a float assembly slidably mounted on the riser tube and having an aperture cover adapted to cover the aperture of the second conduit as fluid rises within the recovery tank and a backflow prevention valve positioned in the first conduit to prevent fluid from passing from the interior of the recovery tank out through the first conduit.

37. A portable extraction cleaner comprising:

a housing assembly including a housing enclosure centrally mounted on a housing base and a handle formed on the housing enclosure and adapted for user carrying of the extraction cleaner;

a suction motor and impeller assembly mounted within the housing enclosure;

a solution tank for cleaning solution removably mounted to the housing base at one side of the housing enclosure;

a recovery tank removably mounted to the housing base at another side of the housing enclosure and having an air/liquid separator; and a working air conduit through the housing base between the impeller inlet opening and the recovery tank.

38. A portable extraction cleaner comprising:

a housing assembly including a housing enclosure centrally mounted on an elongated housing base having a longitudinal axis and a handle formed on the housing enclosure in alignment with the housing longitudinal axis of the elongated housing base and adapted for user carrying of the extraction cleaner;

a suction source mounted within the housing enclosure;

a solution tank for cleaning solution removably mounted to the housing base at one axial side of the housing enclosure;

a recovery tank removably mounted to the housing base at another axial side of the housing enclosure and having an air-liquid separator.

39. The portable extraction cleaner according to claim 38 wherein the suction source has an inlet opening between the housing enclosure and the base and further comprising a conduit through the base from the recovery tank to the inlet opening for drawing air from the recovery tank to the suction source.

40. A portable extraction cleaner comprising:

a housing assembly including a housing enclosure mounted on a housing base and a handle adapted for user carrying of the extraction cleaner;

a suction source mounted within the housing enclosure;

a solution tank for cleaning solution and a recovery tank removably mounted to the housing base; and a decorative face plate that is removably mounted to the housing enclosure and that is adapted to cover at least a substantial visible portion of the visible surface of the housing enclosure.

41. The portable extraction cleaner according to claim 40 wherein the decorative face plate is one of a plurality of different decorative face plates that are adapted to be removably mounted to the housing enclosure and each of which is adapted to cover at least a substantial visible portion of the visible surface of the housing enclosure when mounted on the housing enclosure.

* * * * *